US006735798B1

(12) United States Patent
Sekizawa

(10) Patent No.: US 6,735,798 B1
(45) Date of Patent: May 18, 2004

(54) CHIROPRACTIC AIDS FOR USE ACCOMPANYING CHIROPRACTIC THERAPY

(75) Inventor: Yoshinobu Sekizawa, Ibaraki (JP)

(73) Assignee: Seishin Co., Ltd., Ibaraki (JP)

( * ) Notice: Subject to any disclaimer, the term of this patent is extended or adjusted under 35 U.S.C. 154(b) by 0 days.

(21) Appl. No.: 10/604,648

(22) Filed: Aug. 7, 2003

(30) Foreign Application Priority Data

Aug. 28, 2002 (JP) ..... P2002-248038

(51) Int. Cl.[7] ..... A47C 20/00
(52) U.S. Cl. ..... 5/632; 5/640; 5/630
(58) Field of Search ..... 5/632, 640, 630, 5/722–723, 657

(56) References Cited

U.S. PATENT DOCUMENTS 2,724,133 A * 11/1955 Sorrell ..... 441/127
4,635,306 A * 1/1987 Willey ..... 5/632

* cited by examiner

*Primary Examiner*—Teri Pham Luu
*Assistant Examiner*—Fredrick Conley
(74) *Attorney, Agent, or Firm*—Judge Patent Firm

(57) ABSTRACT

Chiropractic aids for releasing tension in the muscle groups that act to form anteroposterior curvature in the lumbosacral region. Usable with wedge-shaped pads and a rectangular pillow, the principal aid is a convertible triangular pillow having two right-triangular members detachably hinged along their right-angle corners by a first surface fastener. A second surface fastener is provided on each right-triangular cylindrical member edgewise opposite the right-angle corner. Thus the surfaces defined by the counterpart short sides of the right-triangular cylindrical members can be detachably fastened together by the fasteners. To accord with an individual's lumbosacral region the triangular pillow is convertible by employing the two right-triangular cylindrical members: in combination hinged by the first and fastened by the second fasteners; hinged only and folded onto each other; unhinged (and unfastened) but stacked into other arrangements, in which like faces are not mated, or into a parallelepiped; or isolated and separately.

9 Claims, 18 Drawing Sheets

CHIROPRACTIC AIDS FOR USE ACCOMPANYING CHIROPRACTIC THERAPY

BACKGROUND OF INVENTION

1. Technical Field

The present invention relates to chiropractic aids used accompanying chiropractic therapy, and in particular to chiropractic aids for chiropractic therapy to correct curvature of the spine.

2. Description of the Related Art

Knee pillows and rectangular pillows are conventional examples of chiropractic aids used on the floor or bed. A knee pillow that is commercially available is a triangular cylinder whose transverse length is 40 cm, and in cross-sectional contour is a triangle whose sides are 25 cm×27 cm×30 cm in length. A specific example of this pillow is represented by E (and referred to as "knee pillow E" hereinafter) in FIG. 12. The knee pillow E is put under the legs in the supine position.

A rectangular pillow that is commercially available is a quadrilateral cylinder whose sides are 8 cm×13 cm×33 cm in length. A specific example of this pillow is represented by F (and referred to as "rectangular pillow F" hereinafter) in FIG. 13.

An additional example of such chiropractic aids is a chest-resting pad used when the treatment bed does not have a hollow to accommodate the face. This chest-resting pad is wedge-shaped in cross-sectional contour in the portion on which the chest rests, and oblong in the portion for the face; its width is the width of the body or so; and a U-shaped notch that the face enters is formed in the center of the rectangular portion. Any of these therapeutic aids are used by therapists while giving therapeutic treatment.

When a human being is standing erect, the spine in its normal condition, which is shown in FIG. 19—a left-side view of the spine—is anteroposteriorly curved by the groups of muscles that support it. Curvature in the lumbosacral region, indicated as Y in FIG. 19, is particularly crucial.

The curvature in the lumbosacral region Y is balanced erect by muscle groups—one specific example of which are the iliacus muscles—involving the front and back of the sacrum (S in FIG. 19), and by muscle groups—one specific example of which are the psoas major muscles—involving the front and back of the lumbar vertebrae (LV in FIG. 19).

On the other hand, in the supine position the spine normally becomes nearly horizontal, that is, the anteroposterior curvature in the lumbosacral region Y approaches being truly upright, as is illustrated in FIG. 20A.

Notwithstanding what curvature in the lumbosacral region should be, in daily life: a) one and the same posture is often assumed for long periods, leading to muscle fatigue and muscle tension because only the same muscles are used, and giving rise to deterioration of the abdominal and back muscles; and b) working long hours in a forward-leaning posture increases frontward distortion (lordotic curvature) in the lumbar vertebrae, because the back muscles and extensor muscle groups of the trunk, such as those in the anterior side of the thighs, are extensively used while one is unawares. Moreover, c) often being in a posture of sitting in place tends to deteriorate the flexor muscle groups of the trunk, such as the abdominal muscles and the muscles of the buttocks, and makes the extensor muscle groups of the trunk relatively strong, which also increases frontward distortion (lordotic curvature) in the lumbar vertebrae.

Compounding of these causes ends up leaving anteroposterior curvature in the lumbosacral region Y in the same state even when in the supine position, because the muscle-group tension that acts when standing upright persists. FIG. 20B illustrates this condition.

When this muscle-group tension remains, sustaining curvature in the lumbosacral region Y as shown in FIG. 20B, distortion is induced in the spine, which has various bad effects—for example, giving rise to low-back pain.

Therefore, the present inventor invented—and filed Japanese Pat. App. No. 2001-151373 on—aids for active corrective therapy in order to correct lumbosacral anteroposterior curvature in the supine position and horizontally condition the spine, in order that is, to make anteroposterior curvature in the lumbosacral region truly upright.

This invention involves aids for chiropractic therapy used accompanying chiropractic treatment, and renders chiropractic aids lent the capacity to release tension in the muscle groups that act to form anteroposterior curvature in the lumbosacral region of the spine, so as to enable correcting anteroposterior curvature in the lumbosacral region to be close to truly upright.

The invention in particular is the utilizing of three types of wedge-shaped pad, whose cross-sectional contour is wedge-shaped and whose transverse width is the width of the body or so—being: a short-span wedge-shaped pad B, as shown in FIG. 9, of length that covers the buttocks when the ridge of the wedge is set against the lumbosacral region; a mid-span wedge-shaped pad C, as shown in FIG. 10, of length to reach the knee; and a long-span wedge-shaped pad D, as shown in FIG. 11, of length to cover the parietal region—and employing one pad to three of the pads in combination, according to different figures and to individual differences in anteroposterior curvature in the lumbosacral region of the spine, to enable correction of lumbosacral anteroposterior curvature into a condition at will in a range extending to truly upright.

The invention furthermore is the utilization of a convertible triangular pillow—which is characterized in that: two right-triangular cylindrical members whose cross-sectional contour is made up of right-triangular shapes having a long side and a short side are combined; the right-angle corners of right-triangular cylinders are hinged together; and surface fasteners are provided respectively on the surfaces defined by the right-angle corner and the long side, and the right-angle corner and the short side; and by fastening with the surface fasteners the surfaces defined by the matching short sides, and the surfaces defined by the matching long sides, when the surface defined by any chosen side is made the base of the triangular cylinder, the angle of the apex of the triangular cylinder can be changed—wherein setting the convertible triangular pillow against the underside of the lower legs to flex the lower legs and mitigate tension in the iliopsoas muscles enables correction of lumbosacral anteroposterior curvature into a condition, as far as truly upright, at will.

Alternatively, the abovementioned three types of pads B, C and D and the above-described convertible triangular pillow are employed in combination, according to individual differences/differences in figure, making it possible to correct lumbosacral anteroposterior curvature into a condition, as far as truly upright, at will.

The foregoing invention relates to aids for chiropractic therapy used accompanying chiropractic treatment, and rendered chiropractic aids lent the capacity to release tension in the muscle groups that act to form anteroposterior curvature in the lumbosacral region of the spine, so as to enable correcting anteroposterior curvature in the lumbosacral region to be close to truly upright.

Then lone or combined use of the three types of wedge-shaped pad—which are the short-span wedge-shaped pad B, the mid-span wedge-shaped pad C, and the long-span wedge-shaped pad D—as well as the convertible triangular pillow, and employing in combination with knee pillow E and rectangular pillow F was effective in that individual differences, such as different physiques and figures, could be handled.

Nevertheless, a drawback has been that kinds of chiropractic aids employed to handle individual differences such as differences in physique and figure have been numerous.

SUMMARY OF INVENTION

The present invention remedies the drawback just noted, making it possible to handle individual differences such as differences in physique and figure by means of a simple chiropractic therapy aid.

The present invention is employed accompanying chiropractic therapy to correct anteroposterior curvatures in the lumbosacral region of the spine, wherein as a chiropractic treatment aid, a convertible triangular pillow is principally utilized.

From the following detailed description in conjunction with the accompanying drawings, the foregoing and other objects, features, aspects and advantages of the present invention will become readily apparent to those skilled in the art.

DETAILED DESCRIPTION

Examples of the present invention are described according to figures as follows.

Chiropractic treatment aids having to do with the present invention are used accompanying chiropractic therapy, in which two right-triangular cylindrical members are combined, in which the right-triangular cylindrical members are connected in order to be revolvable and detachable at the right angle edge, and each plane of short side and each plane of long side of two right-triangular cylindrical members are fastened each other, and a separated right-triangular cylindrical member is solely used, or two are combined to use as a convertible triangular pillow. This convertible triangular pillow is shown as A in FIG. 1 (convertible triangular pillow A).

In addition, the present invention means treatment aids for chiropractic therapy comprising convertible triangular pillow A, combined with three types of wedge-shaped pad in which its cross-section is wedge-shaped and its width is nearly the same as the width of body, comprising a short wedge-shaped pad which covers the buttock when its point of wedge-shape contacts the lumbosacral region, a medium wedge-shaped pad which reaches the knee and a long wedge-shaped pad which covers the parietal region, in which the medium wedge-shaped pad has a shallow concave part with long axis for thigh at the top side, and the long wedge-shaped pad has a shallow concave part for the occiput at the top side. In this case, more than one of three types of wedge-shaped pad are stacked to use. Furthermore, publicly known square-pole-shaped square pillow can be combined with convertible triangular pillow A or combination of convertible triangular pillow A and three types of wedge-shaped pad.

Embodiment 1

Figure 1:
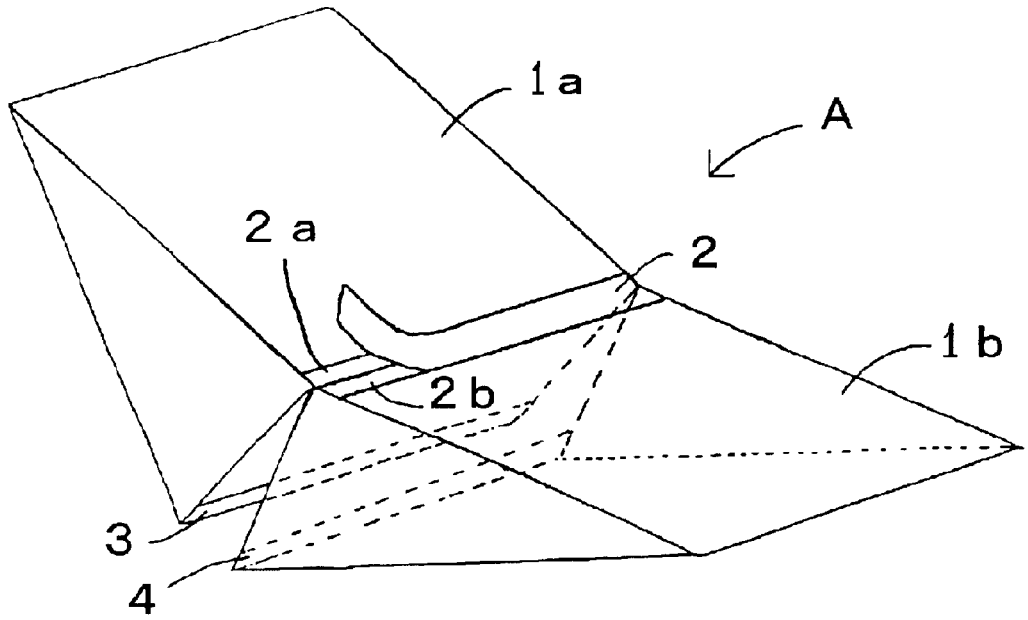
FIG. 1 is a perspective view showing convertible triangular pillow A.

For a convertible triangular pillow A, as shown by A in FIG. 1, two right-triangular cylindrical members 1*a* and 1*b* whose cross-sectional contour is made up of right-triangular shapes having a 37-cm long side and a 20-cm short side were prepared. Also, a surface fastener 2 of 5.0 cm width was prepared. Then surface fasteners 2*a* and 2*b* of 2.5 cm width were attached to the right-triangular cylindrical members 1*a* and 1*b*, stretching along their right-angle corner to their long sides, and surface fasteners 3 and 4 of 2.5 cm width were respectively attached on the edge surface opposite the right-angle corner, in the plane defined by the right-angle corner and the short side.

The two right-triangular cylindrical members 1*a* and 1*b* prepared in this way are mated at the faces defined by the counterpart short sides, and surface fastener 2 is matched with surface fasteners 2*a* and 2*b* fastened along the right-angle corner running to the long sides, to dual-combine the right-triangular cylindrical members 1*a* and 1*b*, and de/reattachably hinging them the right-angle corners of the right-triangular cylinders.

Further, surface fasteners 3 and 4 being attached at the edge surface opposite the right-angle corner, in the plane defined by the right-angle corner and the short side, makes it so that the faces defined by the short sides can be firmly fixed to each other with surface fastener 2 and surface fasteners 3 and 4.

Materials of the convertible triangular pillow A are publicly known materials such as leather, imitation leather and cloth for the surface, and publicly known materials such as sponge and foam for inside.

In Embodiment 1, the cross-section of the convertible triangular pillow A is 37 cm in the long side and 20 cm in the short side. However, it is possible to change length of the cross-section of the convertible triangular pillow A, if necessary. Accordingly, it can be 34 cm in the long side and 18 cm in the short side, or 39 cm in the long side and 21 cm in the short side.

FIG. 2 shows variable pillow A is combined using surface fastener at the right angle edge to connect the right-triangular cylindrical members 1*a* and 1*b* in order to be revolvable. In this way, one of the planes of triangle pole become base, and the apex of triangle pole can be changed as shown in FIGS. 2A to 2E in FIG. 2.

The angle of apex of the convertible triangular pillow A increases greatly in order of FIGS. 2A, 2B, 2C, 2D and 2E.

This example is same as the example shown in FIG. 2 of Patent Application No. 2001-151373.

FIG. 3 shows surface fastener 2 at the right angle edge of right-triangular cylindrical members 1*a* and 1*b* is taken off so as to use each right-triangular cylindrical member 1*a* and 1*b* separately. In this case, the angle of apex of right-triangular cylindrical members 1*a* and 1*b* increases in order of FIGS. 3A, 3B, 3C, and 3D.

FIG. 4 shows right-triangular cylindrical members 1*a* and 1*b* are separated. One is placed with its plane of right angle edge and long side as a base, and the other is combined so as not to face each plane of hypotenuse each other. The angle of apex made by right-triangular cylindrical members 1*a* and 1*b* increases in order of FIGS. 4A, 4B, 4C, and 4D.

In the same way, FIG. 5 shows right-triangular cylindrical members 1*a* and 1*b* are separated. One is placed with the right angle edge up, and the other is combined so as not to face each plane of long side each other. The angle of apex made by right-triangular cylindrical members 1*a* and 1*b* increases in order of FIGS. 5A, 5B, 5C, and 5D.

Figure 6A:
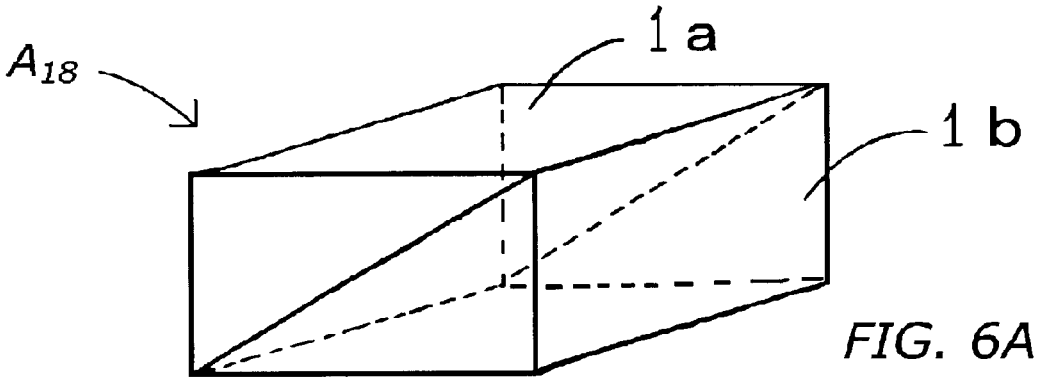
FIG. 6 illustrates Use Example 3 in which two single convertible triangular pillows A are combined, wherein the height of FIG. 6A is higher than 6B.

Furthermore, FIG. 6A shows right-triangular cylindrical members 1*a* and 1*b* are separated. One is placed with its plane of right angle edge and long side as a base, and the other is placed with its plane of right angle edge and long side up, and each plane of hypotenuse is faced to place two right angle edges in symmetry so as to form a rectangular cross-section.

Figure 6B:
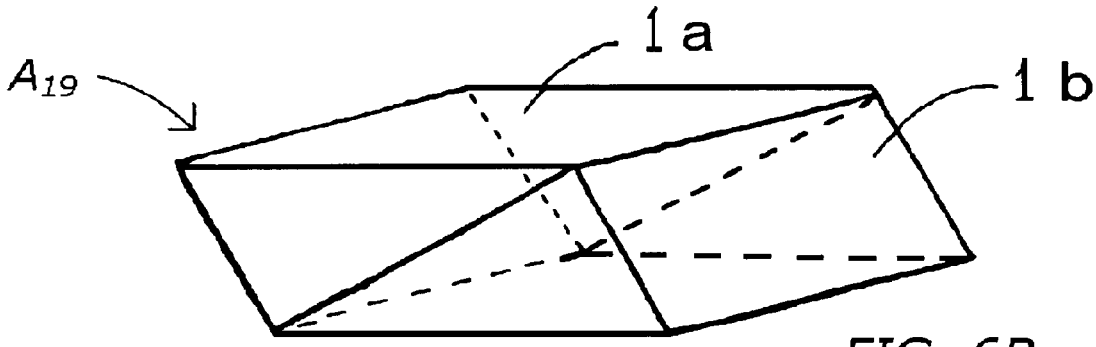

In the same way, FIG. 6B shows right-triangular cylindrical members 1*a* and 1*b* are separated. One is placed with its plane of hypotenuse as a base and with its plane of right angle edge up, and the other is placed with its plane of right angle edge as a base, and each plane of long side is faced to place two right angle edges in symmetry so as to form a parallelogram in cross-section.

In this case, the height of FIG. 6A is higher than 6B.

Embodiment 2

Since convertible triangular pillow A of the present invention has a lot of variation for use, as described in Embodiment 1, (1) the convertible triangular pillow A is used, in which two right-triangular cylindrical members 1*a* and 1*b* are combined, in which the right-triangular cylindrical members are connected in order to be revolvable at the right angle edge using surface fastener 2, and surface fastener 3 and 4 attached at the edge parallel to the right angle edge of the plane of the right angle edge by the short side so as to fasten each plane with the short side, (2) the convertible triangular pillow A is used, in which two right-triangular cylindrical members 1*a* and 1*b* are combined, in which the right-triangular cylindrical members are connected in order to be revolvable at the right angle edge using surface fastener 2, and planes of the right angle edge by the long side are faced each other, (3) surface fastener 2 at the right angle edge of right-triangular cylindrical members 1*a* and 1*b* is taken off so as to use each right-triangular cylindrical member 1*a* and 1*b* separately, (4) surface fastener 2 at the right angle edge of right-triangular cylindrical members 1*a* and 1*b* is taken off to combine two right-triangular cylindrical members 1*a* and 1*b* so as not to face each plane of hypotenuse and each plane of long side each other, (5) surface fastener at the right angle edge of right-triangular cylindrical members 1*a* and 1*b* is taken off to face each plane of hypotenuse and each plane of long side of each right-triangular cylindrical member 1*a* and 1*b* each other so as to form a rectangle or parallelogram in cross-section, examples are shown how to attach non-slip sheets 5 in all planes except triangle planes of right-triangular cylindrical members 1*a* and 1*b* in order to ensure stability in all variation for use.

Non-slip sheets are about 5 cm long, about 1.5 cm wide and about 00 mm thick, and made of elastic material such as natural rubber, synthetic rubber, silicone rubber. It is not restrict to only these sizes and materials for the non-slip sheet and anything should be used to get the same effect.

As for the place to be attached, non-slip sheets are attached from the outside edge of four corners to inside in each plane. In the plane with surface fastener, all non-slip sheets are attached parallel to the right triangle edge in a space where surface fasteners are not attached.

As for the way of attaching, publicly known ways such as using bond and sewing are used.

Figure 7A:
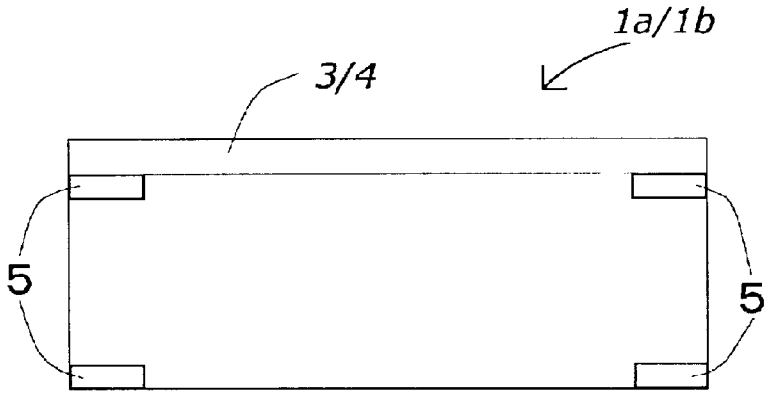
FIG. 7 is a plan view of non-slip sheets attached to each side of convertible triangular pillow A.

FIG. 7A shows an example of plane of right triangle edge by short side.

Figure 7B:
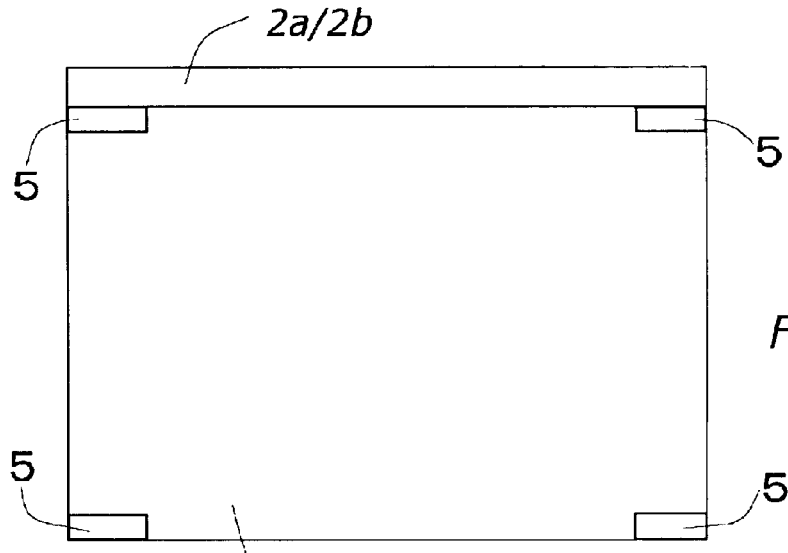

FIG. 7B shows an example of plane of right triangle edge by long side.

Figure 7C:
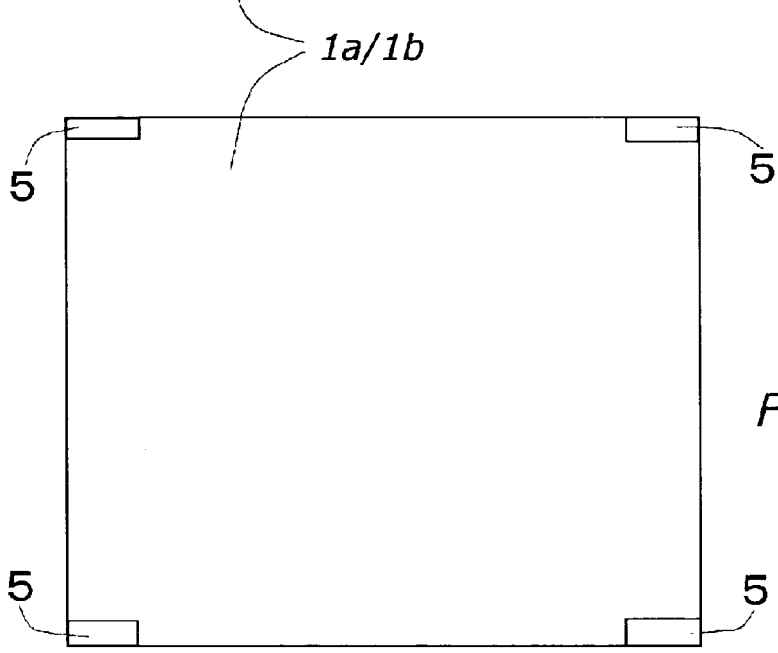

FIG. 7C shows an example of plane of hypotenuse.

Embodiment 3

Since convertible triangular pillow A of the present invention has a lot of variation for use, as described in Embodiment 1 and 2, purpose of use, instructions for use and representative examples are indicated in manner of printing, etc. on the face of convertible triangular pillow A for the user's convenience.

First, as for purpose of use, a phrase such as, "Purpose of use: This is a pillow for forming the most relaxed posture for you" is put in the surface 1*b* shown in FIG. 2B.

Figure 2A:
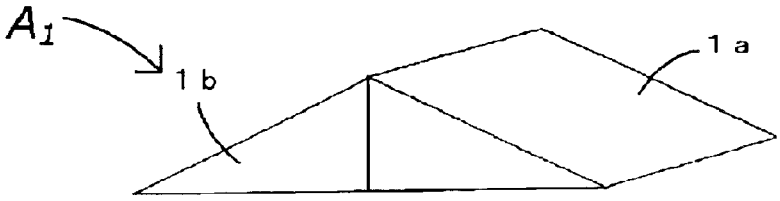
FIG. 2 is an overall perspective view showing the angle of apex increases greatly in the order FIGS. 2A, 2B, 2C, 2D and 2E.
Figure 2B:
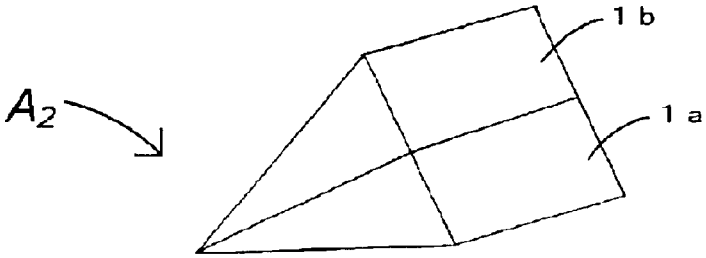

Next, as for notes, displayed in the surface 1*a* shown FIG. 2B are phrases such as: "Notes: 1) Please choose a combination according to your most relaxed position. 2) Your most relaxed position" is not always the same. 3) If you feel uncomfortable lying down, please look for a better posture. 4) Don't just put up with it. 5) For more details, please consult the attached instruction manual."

Needless to say, the surfaces 1*a* and 1*b* shown in FIG. 2B can be upside down. And the content of the indication is not limited to the above phrases.

Figure 2C:
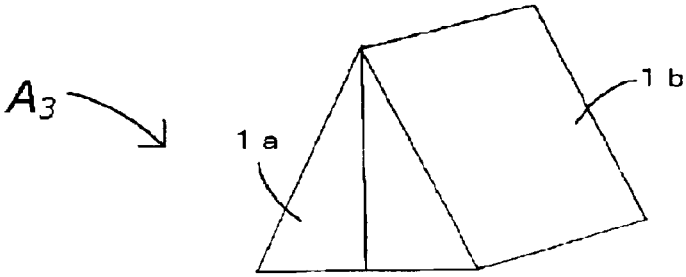
Figure 2D:
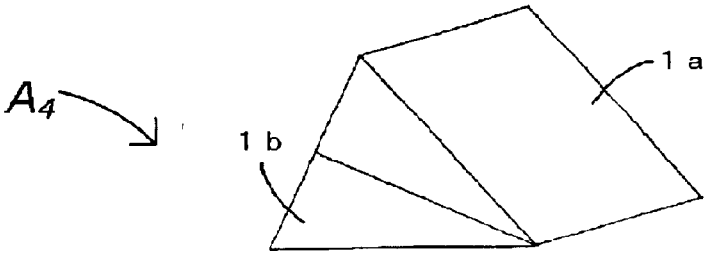
Figure 2E:
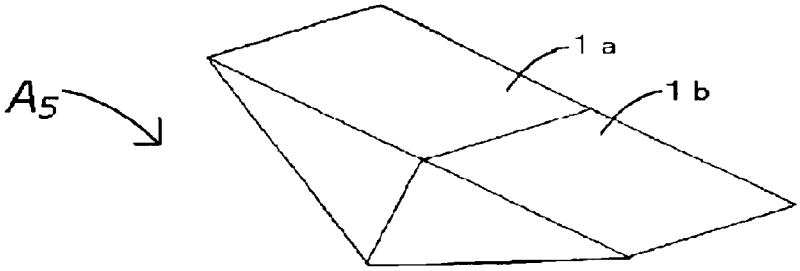
Figure 8A:
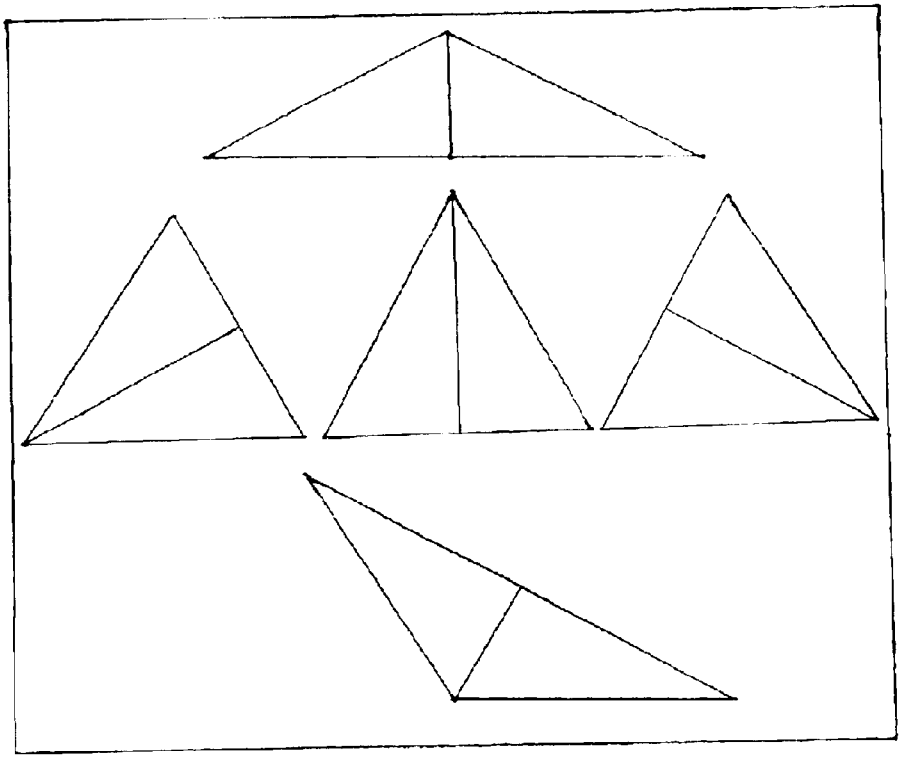
FIG. 8 is examples (FIGS. 8A–8D) of explanatory use diagrams written on a face of the convertible triangular pillow.
Figure 8B:
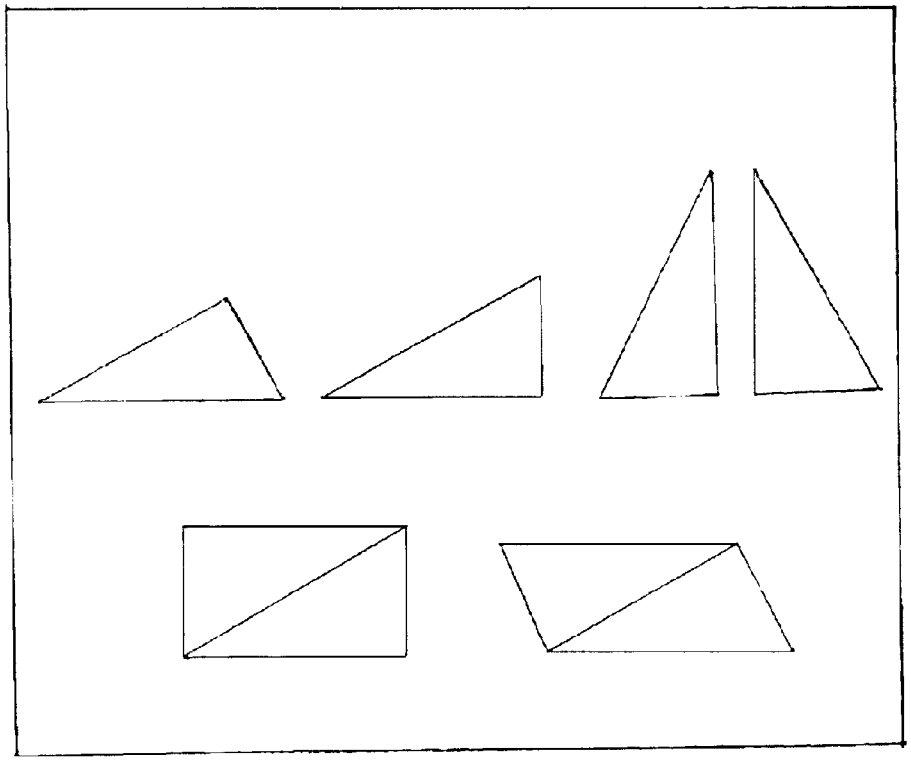
Figure 8C:
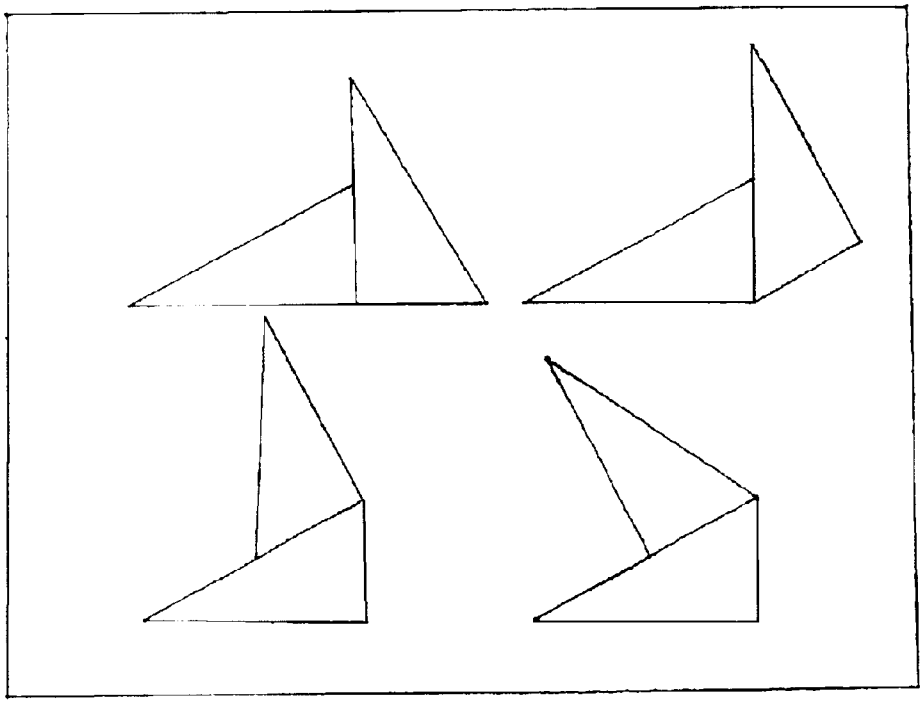
Figure 8D:
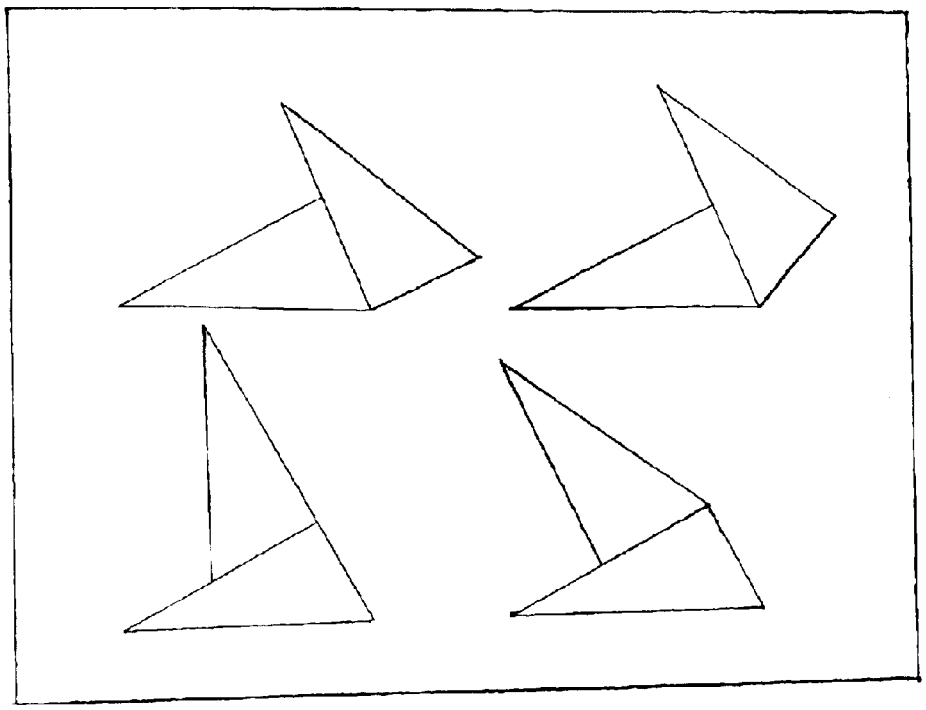

As for representative examples:

FIG. 8A shows an example of sign displaying as a group the use examples of FIGS. 2A through 2E, for attachment to the surface 1*b* in FIG. 2C;

FIG. 8B shows an example of sign displaying as a group the use examples of FIGS. 3A through 3D, and FIGS. 6A and 6B for attachment to the surface 1*a* in FIG. 2D;

FIG. 8C shows an example of sign displaying as a group the use examples of FIG. 4A to 4D for attachment to the surface 1*a* in FIG. 2E; and FIG. 8D shows an example of sign displaying as a group the use examples of FIG. 5A to 5D for attachment to the surface 1*b* in FIG. 2E.

These are examples to be displayed in 1*b* shown in FIG. 2C, 1*a* shown in FIG. 2D, 1*a* shown in FIG. 2E and 1*b* shown in FIG. 2E. These surfaces and Use Examples to be displayed can be chosen as appropriate, and not limited to the above examples.

In this way, users can try a lot of variation smoothly without instructions manual because the note and examples are indicated on the body of convertible triangular pillow A.

Embodiment 4

In the present invention, three types of wedge-shaped pad used together with convertible triangular pillow A are the same as ones described in the patent application No. 2001-151373.

Figure 9:
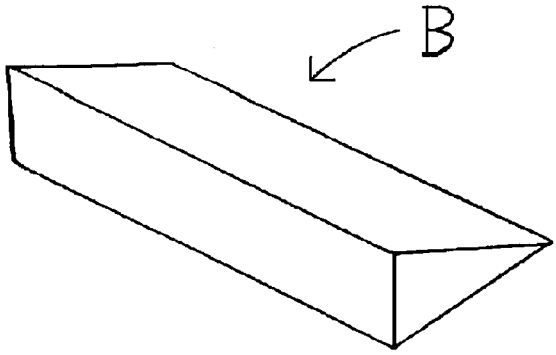
FIG. 9 is an overall perspective view showing short wedge-shaped pad B.

Specifically, short wedge-shaped pad B is a triangle pole with a cross-section of right triangle as shown in B of FIG. 9. Its right angle side is 10 cm long, the other side is 15 cm long, and the width is 45 cm wide.

Figure 10:
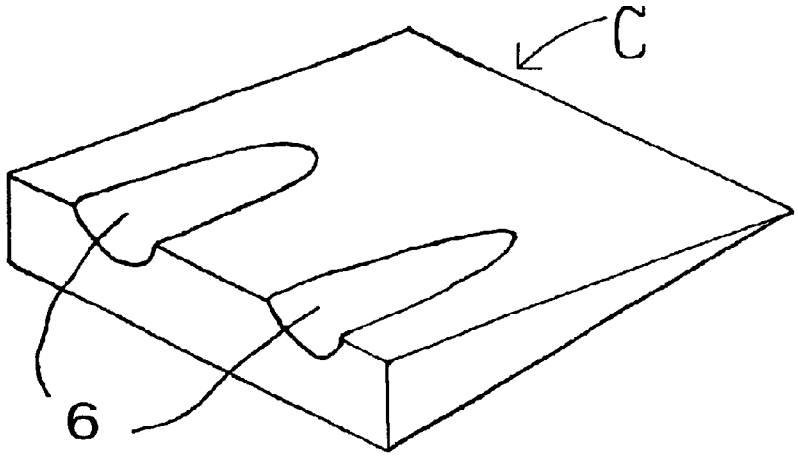
FIG. 10 is an overall perspective view showing a medium wedge-shaped pad C.

Medium wedge-shaped pad C is a triangle pole with a cross-section of right triangle as shown in C of FIG. 10. Its right angle side is 10 cm long, the other side is 50 cm long, and the width is 45 cm wide. It has a shallow concave part 5 with long axis for thigh in the top plane of long side made in the plane of right angles.

Figure 11:
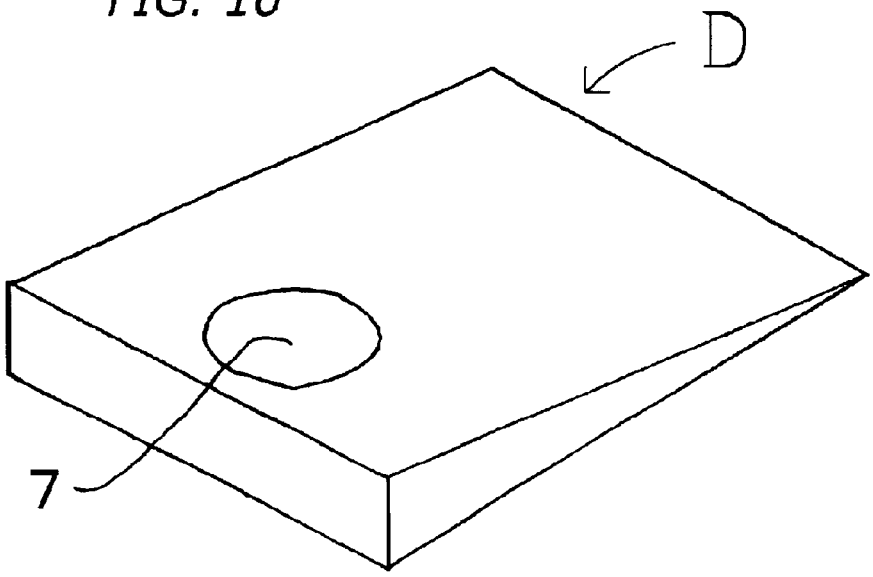
FIG. 11 is an overall perspective view showing a long wedge-shaped mat D.
Figure 12:
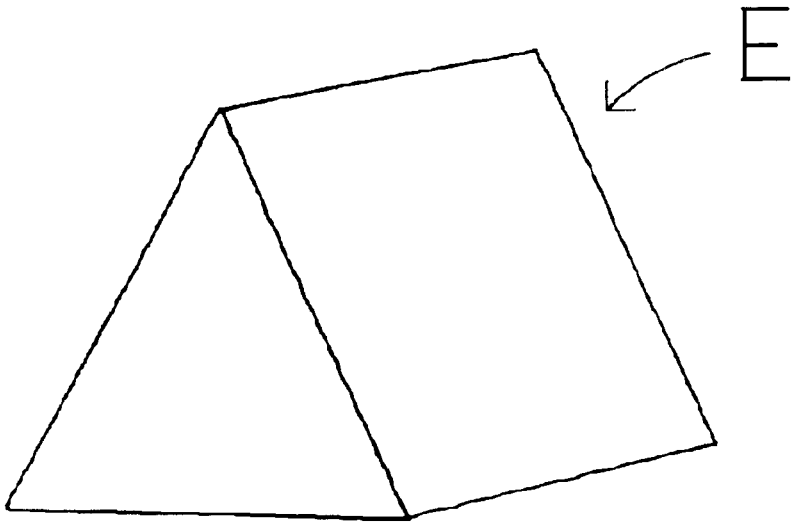
FIG. 12 PRIOR ART
FIG. 12 is a perspective view of a publicly known knee pillow E.

A long wedge-shaped pad D is a triangle pole with a cross-section of right triangle as shown in D of FIG. 11. Its right angle side is 10 cm long, the other side is 55 cm long, and the width is 45 cm wide. It has a shallow concave part 6 for the head in the top plane of long side.

Materials of the three types of wedge-shaped pad are publicly known materials such as leather, imitation leather and cloth for the surface, and publicly known materials such as sponge and foam for inside.

In Embodiment 3, specific figures for the length of each wedge-shaped pad are described, however, these figures are not limited for the three types of wedge-shaped pad used together with the present invention, and can be changed as appropriate according to the personal differences in size and frame.

Use Example 1

The following is an explanation with diagrams about examples of convertible triangular pillow A, examples of combination of convertible triangular pillow A and three types of wedge-shaped pad comprising short wedge-shaped pad B, medium wedge-shaped pad C and long wedge-shaped pad D, and examples of combination with publicly known square-pole-shaped square pillow.

In the examples shown in diagrams, all convertible triangular pillow A and three types of wedge-shaped pad contact its point to the center of lumbosacral region Y. In addition, examples of combination with square pillow F are also described.

First, when convertible triangular pillow A is used, head is put in left side of FIG. 2. At FIGS. 2A to 2D, the point of left side of convertible triangular pillow A contacts the center of lumbosacral region Y, and then the apex of convertible triangular pillow A is placed behind the knee so as to put foot outside of the point of right side of convertible triangular pillow A. In this way, the leg is put on the convertible triangular pillow A. In FIG. 2E, knees are deeply bent to hold the convertible triangular pillow A inside the knee.

Now in the following use examples, a displacement angle indicating the extent to which an anteroposterior curvature in the lumbosacral region Y of the spine is forcedly brought near to horizontal, i.e., truly upright, in the present invention is taken as a correction angle # of the sacrum to the lumbar vertebra.

Originally, the correction angle # is shown as the angle to the horizontal line. However, in this example, the angle is shown to the vertical line in order to avoid a complicated diagram with horizontal line. This applied to all of the following examples.

In the example shown in FIG. 3, the same way stated above applies to the case that surface fastener 2 at the right-triangular cylindrical members 1*a* and 1*b* is taken off so as to use each right-triangular cylindrical member 1*a* and 1*b* separately.

In the examples shown in FIGS. 4 and 5, the same way stated above applies to the case that the separated two right-triangular cylindrical members 1*a* and 1*b* are combined to use.

In the following examples, correction angle #, the sacral angle to the lumbar vertebra, is defined, in this invention, as the degree of correction made after anteroposterior curvatures at lumbosacral region Y are compulsorily corrected to be horizontal, or nearly flat.

For Use Example 1, in FIG. 2, correction angle # turns out to be FIG. 2A<2B<2C<2D<2E.

Figure 3A:
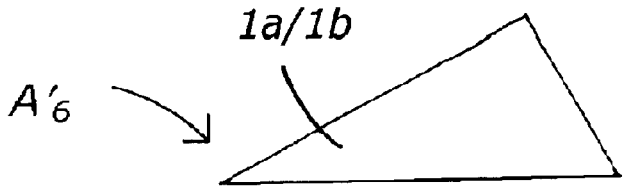
FIG. 3 shows an example of using a separated convertible triangular pillow A alone, wherein the angle of apex increases in the order FIG. 3A, 3B, 3C, and 3D.

In FIG. 3, correction angle # turns out to be FIG. 3A<3B<3C<3D.

Figure 4A:
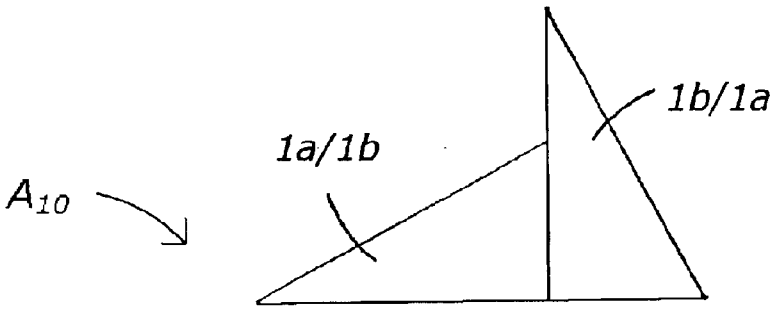
FIG. 4 illustrates Use Example 1 in which two single convertible triangular pillows A are combined, wherein the apex angle increases in the order FIGS. 4A, 4B, 4C, and 4D.
Figure 4B:
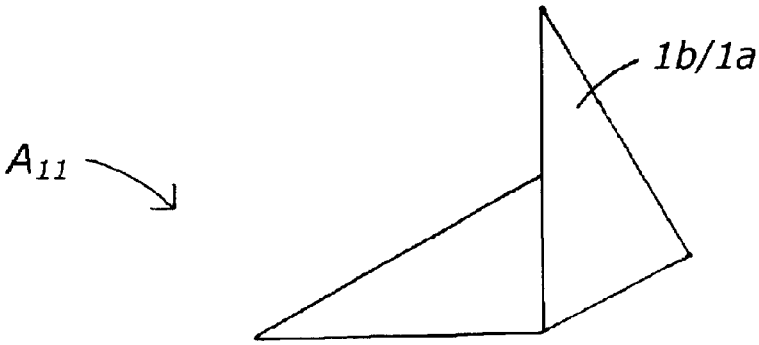

In FIG. 4, correction angle # turns out to be FIG. 4A<4B<4C<4D.

Figure 5A:
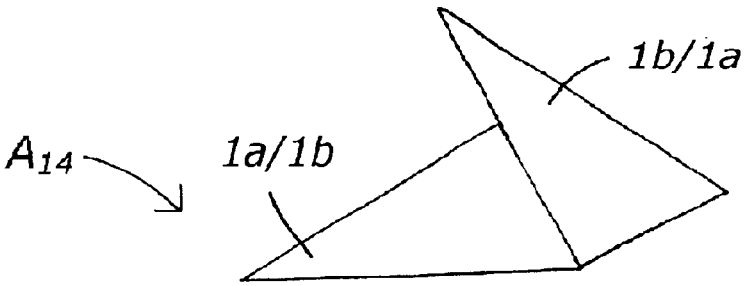
FIG. 5 illustrates Use Example 2 in which two single convertible triangular pillows A are combined, wherein the apex angle increases in the order FIGS. 5A, 5B, 5C, and 5D.
Figure 5B:
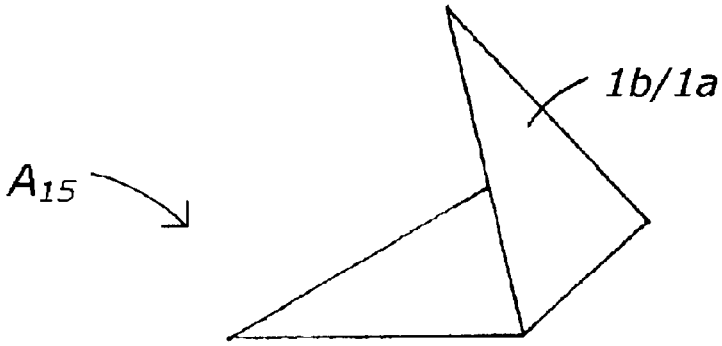

In FIG. 5, correction angle # turns out to be FIG. 5A<5B<5C<5D.

In Use Example 1, diagrams showing relation to human body are omitted.

Use Example 2

Examples in FIG. 14 shows surface fastener 2 at the right angle edge of right-triangular cylindrical members 1*a* and 1*b* is taken off so as to use each right-triangular cylindrical member 1*a* and 1*b* separately, and one or two of short wedge-shaped pad B, medium wedge-shaped pad C and long wedge-shaped pad D used together with the present invention are combined to use.

Figure 14A:
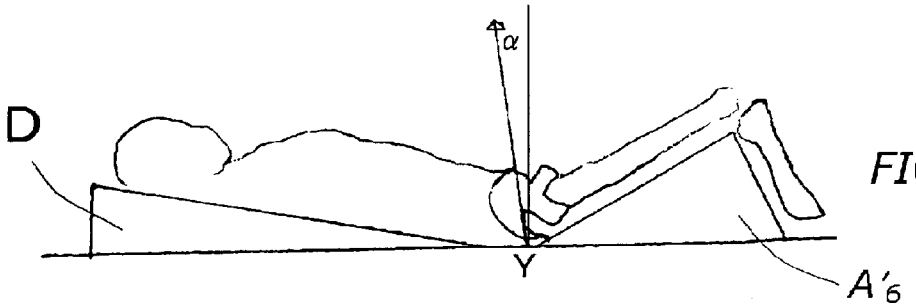
FIG. 14 is for (combined) Use Example 2.

(1) FIG. 14A shows inclination is made from lumbosacral region Y to the head supported with long wedge-shaped pad D at the back, and additionally, right-triangular cylindrical members 1*a* and 1*b* shown in FIG. 3A are placed under the leg so that anteroposterior curvatures at lumbosacral region Y are corrected to be nearly flat in the supine position.

Figure 14B:
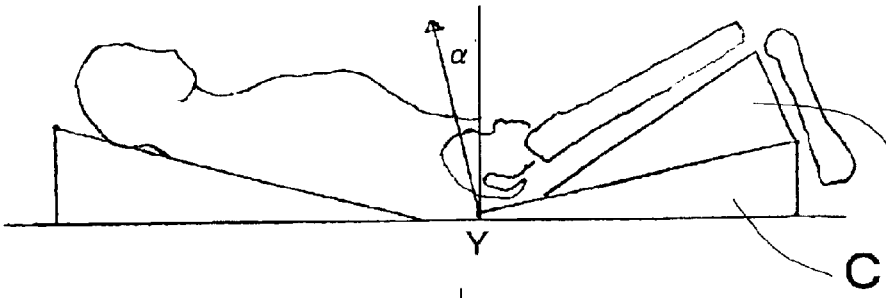

(2) FIG. 14B shows inclination is made from lumbosacral region Y to the head supported with long wedge-shaped pad D at the back, and additionally, right-triangular cylindrical members 1*a* and 1*b* shown FIG. 3A put on medium wedge-shaped pad C are placed under the leg, which makes inclination from the knee to lumbosacral region Y, and lordotic curvature of the sacrum to the lumbar vertebra is decreased and hip joint is lightly flexed because the leg is raised by the pads, and then anteroposterior curvatures at lumbosacral region Y are corrected to be nearly flat in the supine position.

Figure 3B:
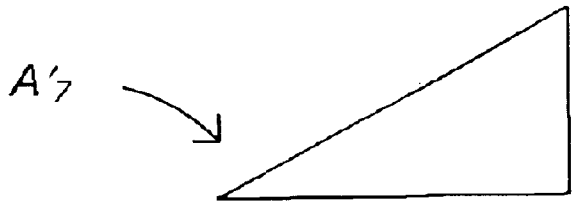
Figure 3C:
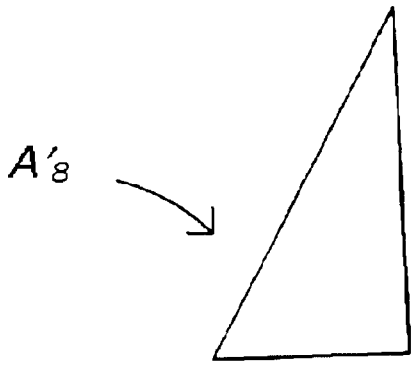
Figure 3D:
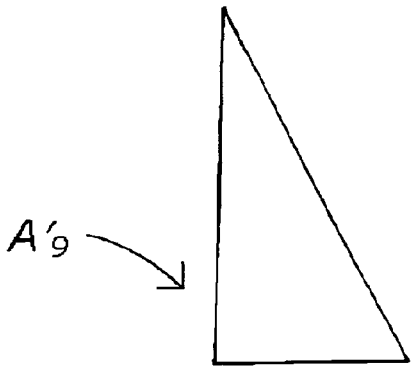
Figure 14C:
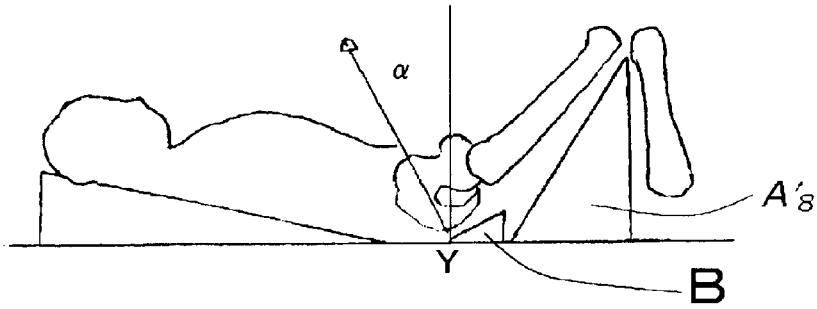
Figure 14D:
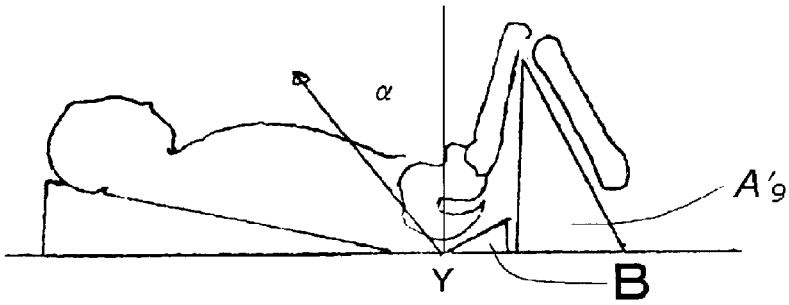

(3) FIG. 14C and 14D shows inclination is made from lumbosacral region Y to the head supported with long wedge-shaped pad D at the back, and inclination is made from the buttock to lumbosacral region Ywith short wedge-shaped pad B at the buttock to support the apex of sacrum from the back of the buttock, and additionally, right-triangular cylindrical members 1*a* and 1*b* shown in FIG. 3C and 3D are placed under the leg, which decreases lordotic curvature of the sacrum to the lumbar vertebra, and then anteroposterior curvatures at lumbosacral region Y are corrected to be nearly flat in the supine position.

In the following example, as stated above, although originally, the correction angle # is shown as the angle to the horizontal line, in this example, the angle is shown to the vertical line in order to avoid a complicated diagram with horizontal line.

In Use Example 2, correction angle # turns out to be FIG. 14A<14B<14C<14D.

Use Example 3

Figure 4C:
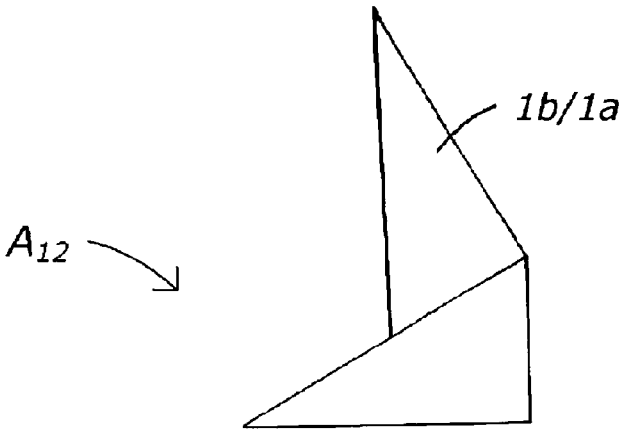
Figure 4D:
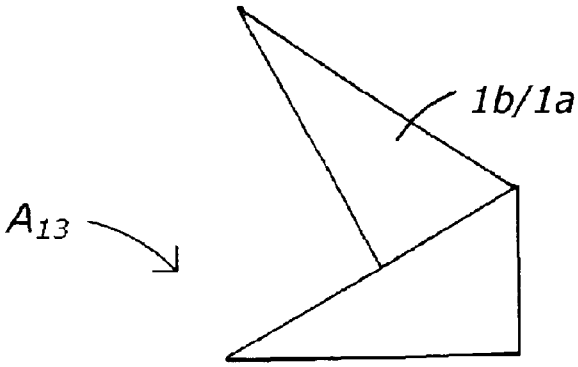
Figure 5C:
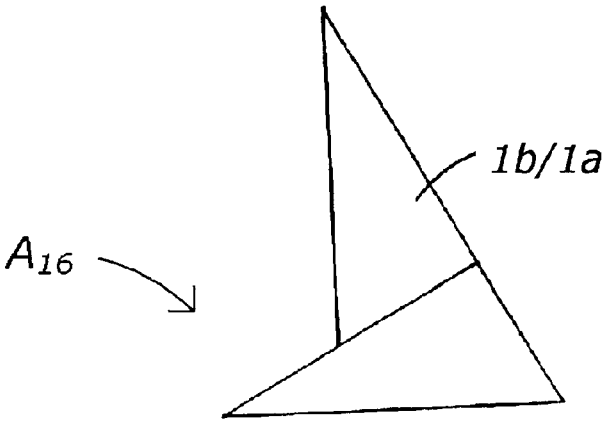
Figure 5D:
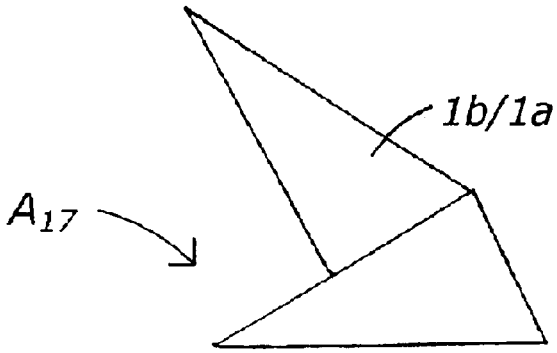
Figure 13:
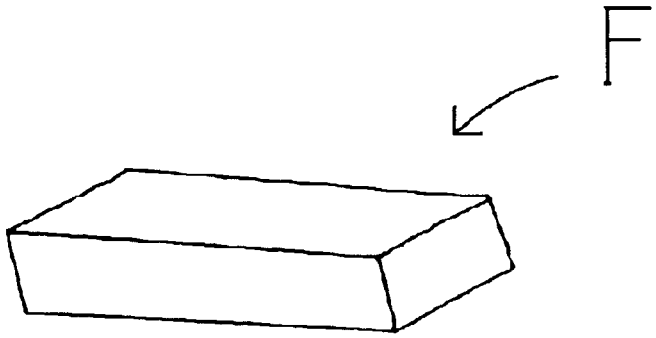
FIG. 13 PRIOR ART
FIG. 13 is a perspective view of a publicly known square pillow F.

In FIG. 15, surface fasteners 2 are taken off from the right angle edge of the right-triangular cylindrical members 1*a* and 1*b* of the convertible triangular pillow A shown in FIGS. 4C and 4D, and FIG. 5D in order to separate and combine the right-triangular cylindrical members 1*a* and 1*b*, and long wedge-shaped pad D used together with the present invention and square pillow F shown in FIG. 13 are combined to use.

Since the way of using is same as Use Example 1 and 2, explanation is omitted.

Figure 15A:
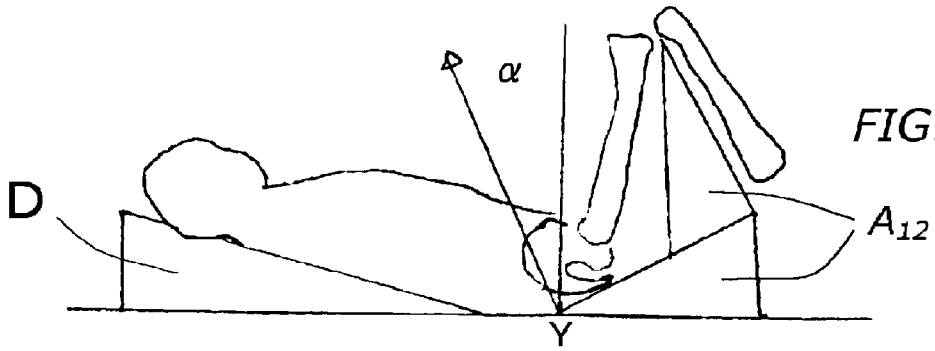
FIG. 15 is for (combined) Use Example 3.

(1) FIG. 15A shows an example of use combined with FIG. 4C and long wedge-shaped pad D.

Figure 15B:
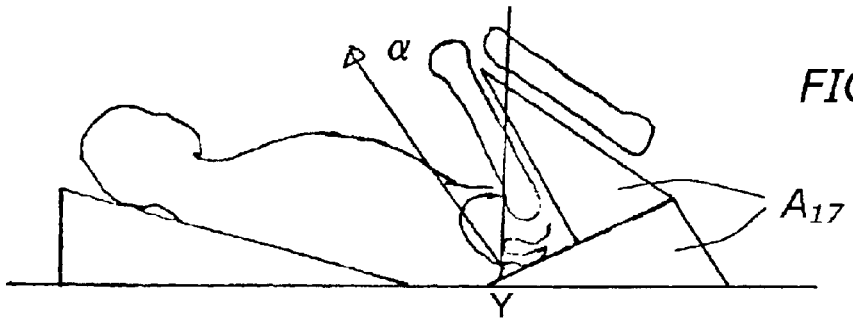

(2) FIG. 15B shows an example of use combined with FIG. 5D and long wedge-shaped pad D.

Figure 15C:
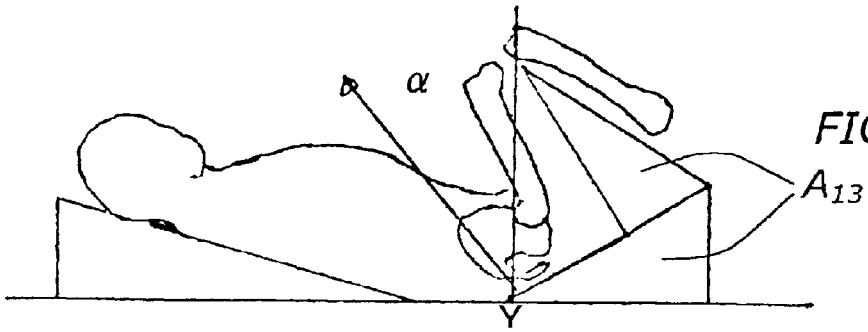

(3) FIG. 15C shows an example of use combined with FIG. 4D and long wedge-shaped pad D.

Figure 15D:
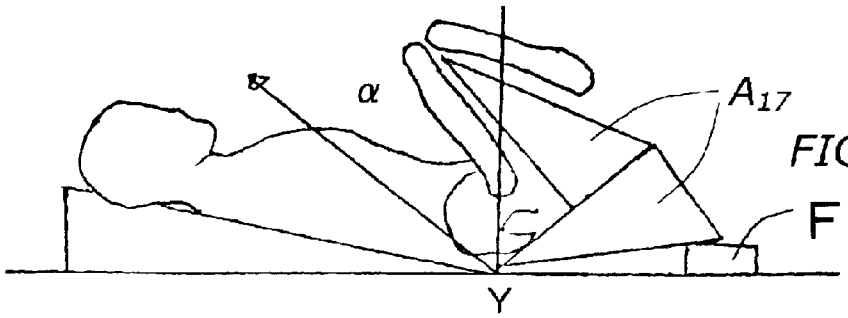

(4) FIG. 15D shows an example of use combined with FIG. 5D and long wedge-shaped pad D, and additionally square pillow F.

In Use Example 3, correction angle # turns out to be FIG. 15A<15B<15C<15D.

Use Example 4

In FIG. 16, surface fasteners 2 are taken off from the right angle edge of the right-triangular cylindrical members 1*a* and 1*b* of the convertible triangular pillow A shown in FIG. 3B and 3D, and FIG. 5A in order to separate the right-triangular cylindrical members 1*a* and 1*b* to use it alone separately or combine, and one or two of three types of wedge-shaped pad comprising short wedge-shaped pad B, medium wedge-shaped pad C and long wedge-shaped pad D used together with the present invention and square pillow F are combined to use.

Figure 16A:
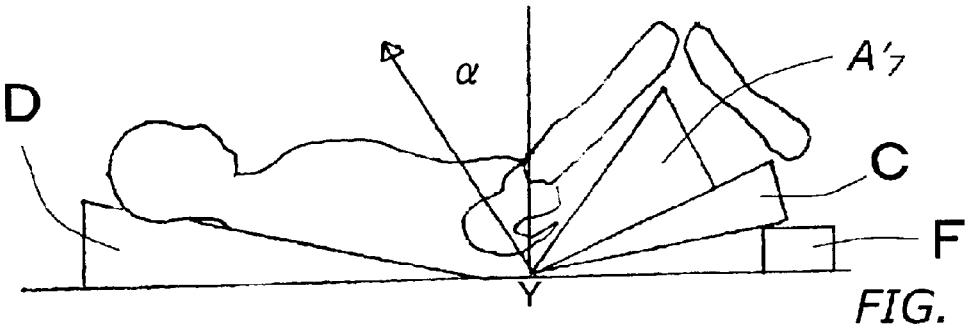
FIG. 16 is for (combined) Use Example 4.

(1) FIG. 16A shows an example of use combined with FIG. 3B, medium wedge-shaped pad C, long wedge-shaped pad D and additionally square pillow F.

Figure 16B:
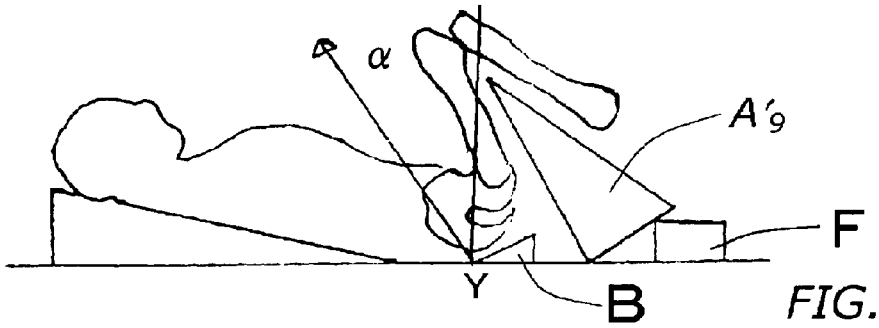

(2) FIG. 16B shows an example of use combined with FIG. 3D, short wedge-shaped pad B, long wedge-shaped pad D and additionally square pillow F.

Figure 16C:
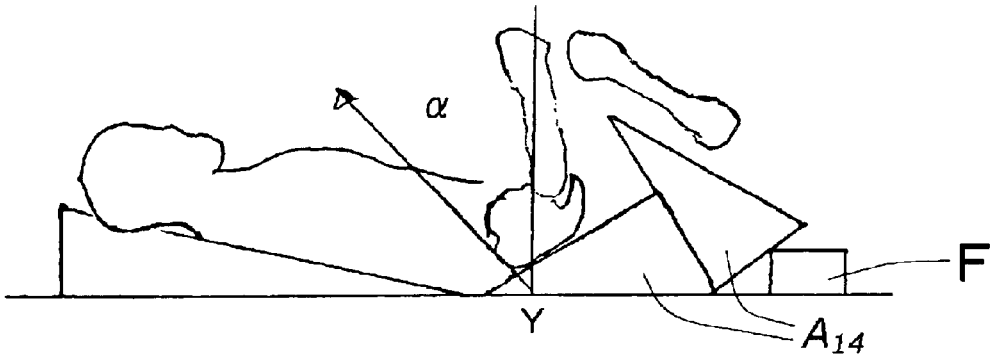

(3) FIG. 16C shows an example of use combined with FIG. 5A, long wedge-shaped pad D and additionally square pillow F.

In Use Example 4, correction angle # turns out to be FIG. 16A<16B<16C.

Use Example 5

In FIG. 17, surface fasteners 2 are taken off from the right angle edge of the right-triangular cylindrical members 1*a* and 1*b* of the convertible triangular pillow A shown in FIG. 3C, FIGS. 4C and 4D, and FIG. 5C in order to separate the right-triangular cylindrical members 1*a* and 1*b* to use it alone separately or combine, and one or two of medium wedge-shaped pad C and long wedge-shaped pad D used together with the present invention and additionally square pillow F are combined to use.

Figure 17A:
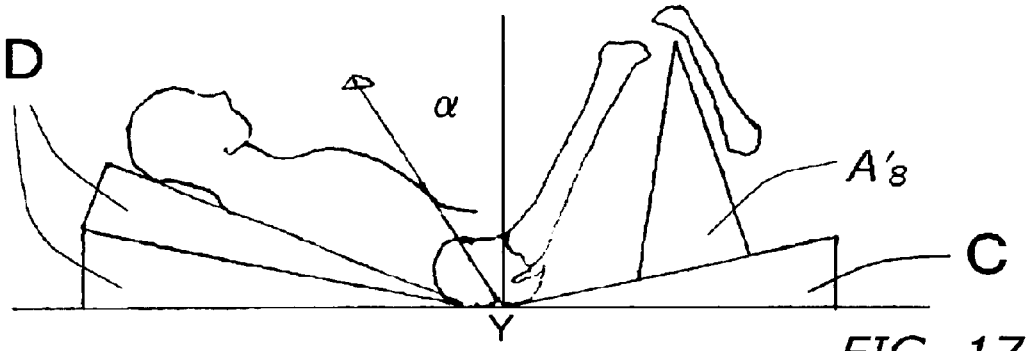
FIG. 17 is for (combined) Use Example 5.

(1) FIG. 17A shows an example of use combined with FIG. 3C, and medium wedge-shaped pad C and long wedge-shaped pad D doubly stacked.

Figure 17B:
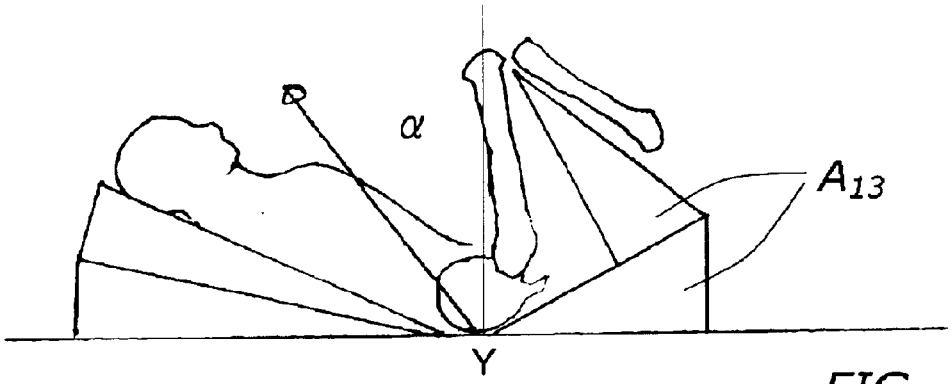

(2) FIG. 17B shows an example of use combined with FIG. 4D and long wedge-shaped pad D doubly stacked.

Figure 17C:
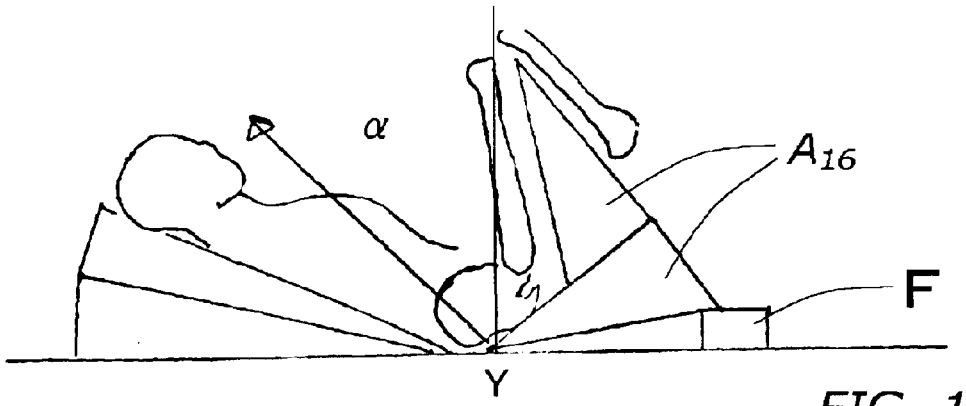

(3) FIG. 17C shows an example of use combined with FIG. 5C and long wedge-shaped pad D doubly stacked and additionally square pillow F.

Figure 17D:
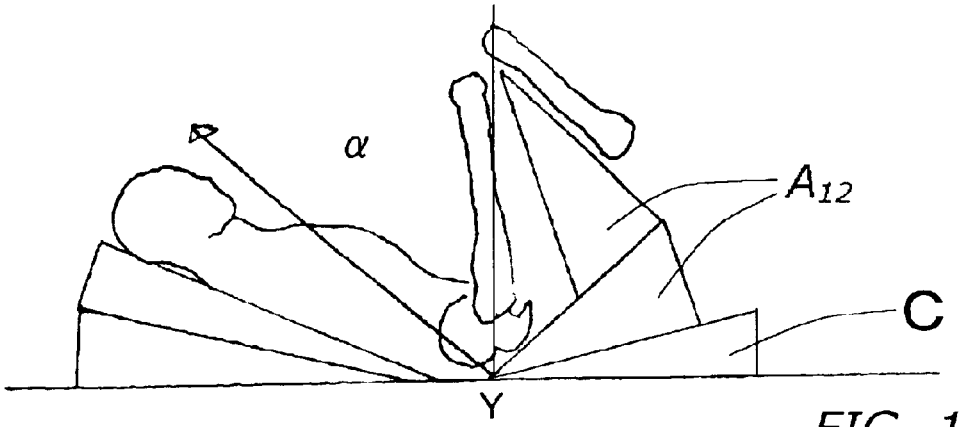

(4) FIG. 17D shows an example of use combined with FIG. 4C, and medium wedge-shaped pad C and long wedge-shaped pad D doubly stacked.

In Use Example 5, correction angle # turns out to be FIG. 17A<17B<17C<17D.

Use Example 6

Contrary to the above use in the supine position, FIGS. 6A and 6B shows an example in the prone position same as on the conventional breast pad. It can reduce anteroposterior curvatures of the spine and make it nearly a horizontal position.

Figure 18A:
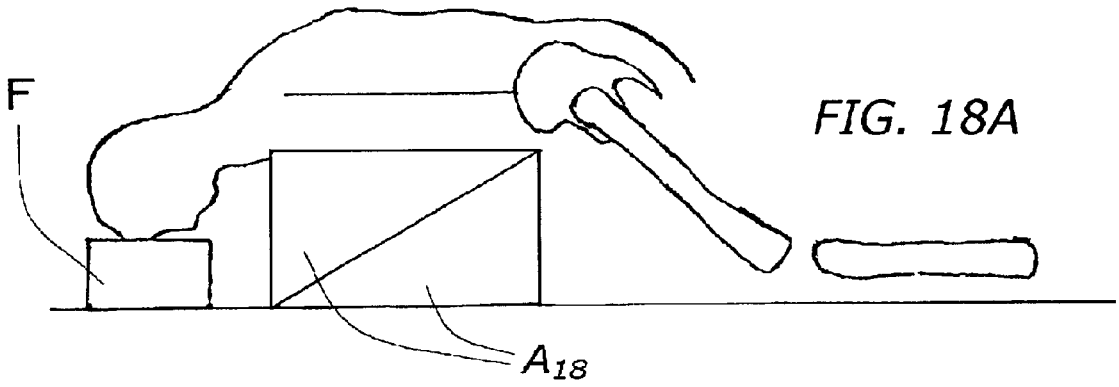
FIG. 18 is for (combined) Use Example 6.
Figure 18B:
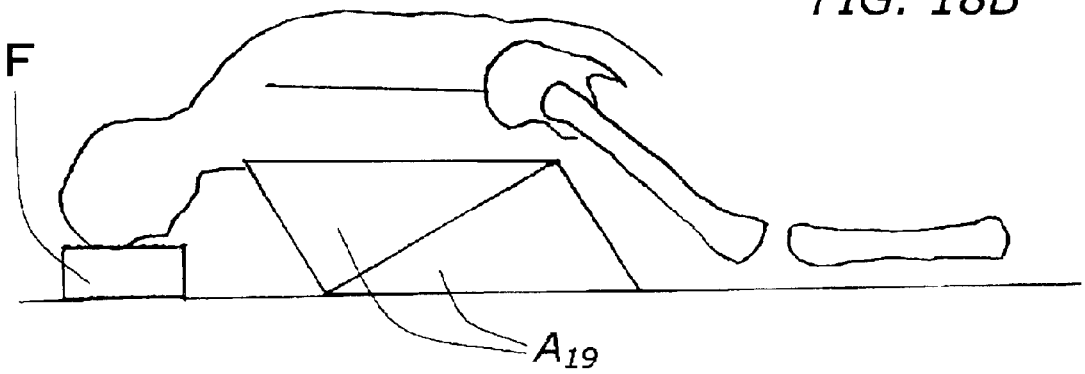
Figure 19:
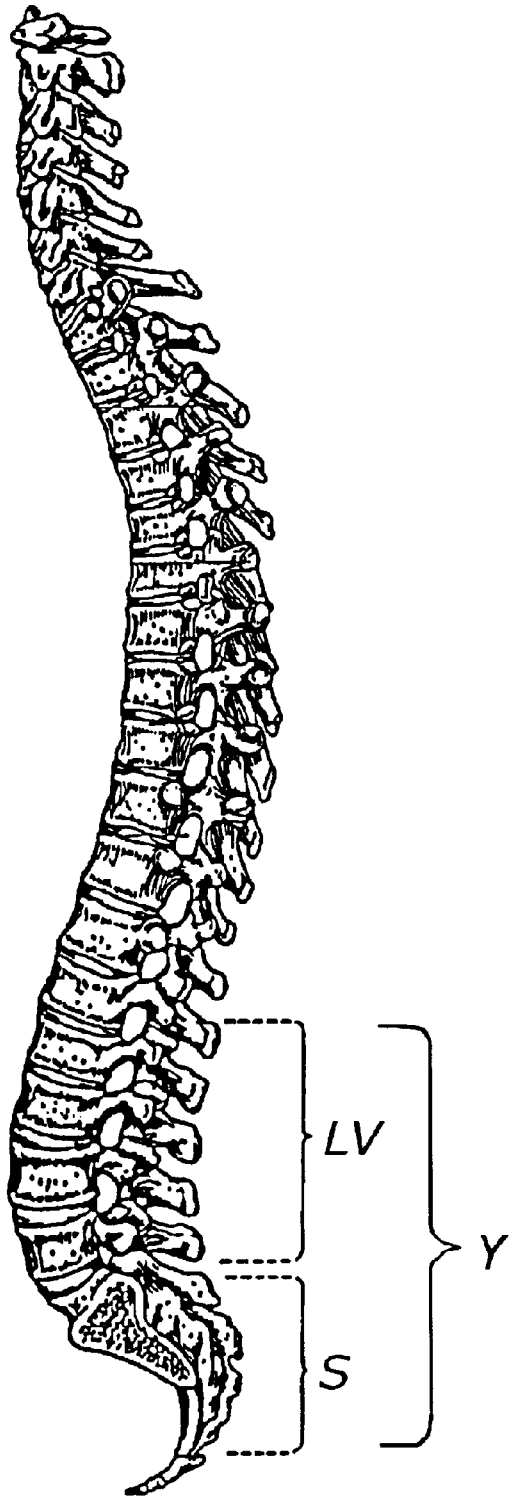
FIG. 19 is a schematic view of the spine showing lumbosacral region Y.
Figure 20A:
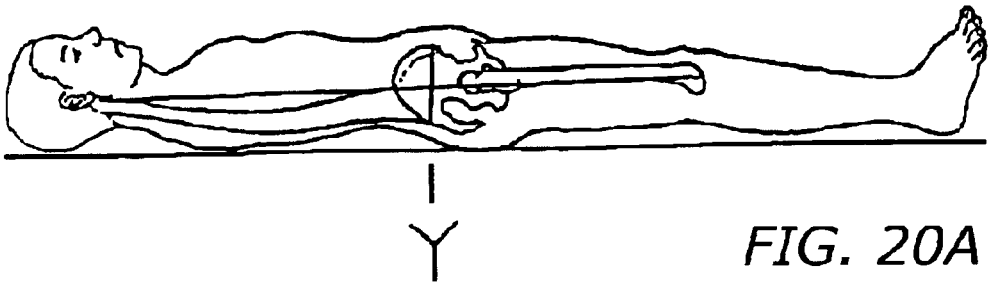
FIG. 20 shows the normal curvatures of the spine in the supine position FIG. 20A, abnormal curvatures of the spine with a greater lordotic curvature in lumbosacral region Y FIG. 20B, reduced lordotic curvature with knee bent even in the case of FIG. 20B with abnormal curvatures FIG. 20C.
Figure 20B:
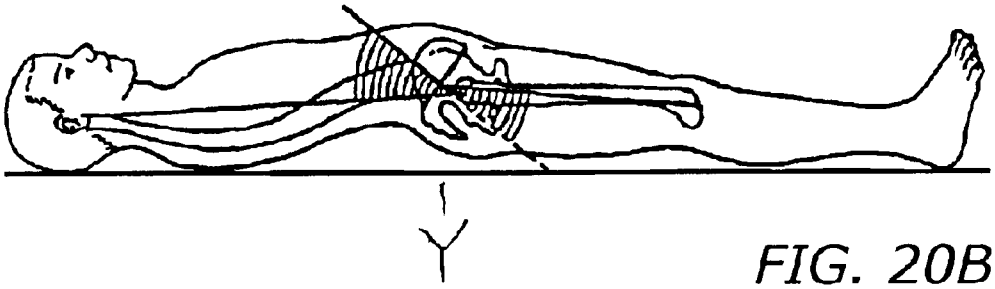
Figure 20C:
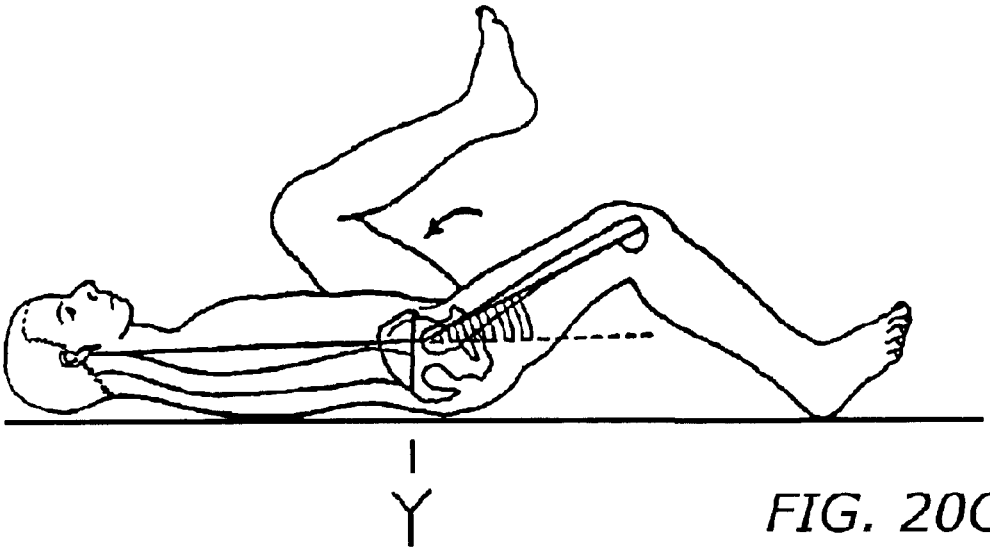

Example of use for FIGS. 6A and 6B are shown in FIGS. 18A and 18B, respectively. As it shows, for the height, FIG. 6A is higher than FIG. 6B, and for the base, FIG. 6B is longer than FIG. 6A. This difference is useful for personal differences in size, etc.

In the above examples of use, correction angle # is shown in normal condition. In fact, the angle varies according to the differences in size and frame. For example, in case of rounded back, when long wedge-shaped pad D is at the back, correction angle # is bigger. And according to the way of combining three types of wedge-shaped pad, the angle is not always shown accurately the degree of correction.

In the above examples, the point of wedge-shaped pad contacts the center of lumbosacral region Y. Actually, in the range of lumbosacral region Y, the point of wedge-shaped pad can be moved to accord with personal differences, for fine adjustments.

In addition, correction angle # can be adjusted by moving the convertible triangular pillow A, three types of wedge-shaped pad and square pillow F.

Although convertible triangular pillow A and three types of wedge-shaped pad comprising a short wedge-shaped pad B, a medium wedge-shaped pad C and a long wedge-shaped D are described as treatment aids for chiropractic therapy used accompanying chiropractic therapy, these treatment aids are not used by therapist during the chiropractic therapy. Accordingly, these can be used regardless of chiropractic therapy.

As stated above, treatment aids for chiropractic therapy of the present invention are used accompanying chiropractic therapy to correct anteroposterior curvatures at lumbosacral region Y. In other words, when it is used before chiropractic therapy, it can release tension of groups of muscles forming anteroposterior curvatures at lumbosacral region Y, which make it easier for chiropractic therapy. When it is used after chiropractic therapy, it can keep the corrected posture and increase the treatment effect. Furthermore, when it is used two times accompanying the therapy, we can get greater effect.

And also, as treatment aids for chiropractic therapy, since the present invention has a lot of variation for combination such as using solely convertible triangular pillow A, using together with three types of wedge-shaped pad comprising a short wedge-shaped pad B, a medium wedge-shaped pad C and a long wedge-shaped D, and using optionally square pillow F, it can deal with personal differences in size and frame.

Furthermore, the treatment aids for chiropractic therapy of the present invention has a simple structure, and a lot of variation for use, and what is more, it is easy to use. For that reason, the treatment aids for chiropractic therapy can be used at home by patients who are familiar with using them under instruction of therapist. In this way, wrong curvatures of the spine caused by daily life can be corrected in daily life.

In addition, although the convertible triangular pillow A of the present invention has a lot of variation for use, non-slip sheet attached to it ensure stability in all use.

Moreover, the convertible triangular pillow A of the present invention has a note and examples of use on its body, accordingly, users can try a lot of variation smoothly without instructions manual.

Although the above examples of use described the convertible triangular pillow A of the present invention are used accompanying chiropractic therapy, these treatment aids are not used by therapist during the chiropractic therapy. Therefore, (1) it can be also used at home without chiropractic therapy after completion of treatment, and (2) it can be also used at home regardless of chiropractic therapy.

Some examples of application used at home without chiropractic therapy are shown as follows.

Application 1

The treatment aids for chiropractic therapy of the present invention can release tension of groups of muscles forming anteroposterior curvatures at lumbosacral region Y, and easily lead to a relaxed posture. Therefore, it allows us (1) to reduce the time to fall asleep, and (2) to reach a deep sleep. For that reason, various effects are expected for the sleep concerning effective short sleep and release from insomnia.

Application 2

Since the treatment aids for chiropractic therapy of the present invention has a lot of variation for use and easily allow us to change body postures, making full use of the characteristics of it, effects for prevention and relief of pressure sore and joint contracture suffered by bedridden patients are expected.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A convertible triangular pillow for use as a chiropractic aid accompanying chiropractic therapy, the convertible triangular pillow comprising:

two right-triangular cylindrical members each of whose cross-sectional contour has a long side, a short side, and a hypotenuse;

a first surface fastener detachably hinging said right-triangular cylindrical members together along their right-angle corners; and second surface fasteners provided on each said right-triangular cylindrical member superficially edgewise opposite the right-angle corner, in the plane defined by the right-angle corner and the short side;

whereby the surfaces defined by the counterpart short sides of said right-triangular cylindrical members can be fastened together by said fasteners.

2. A convertible triangular pillow as recited in claim 1, further comprising non-slip sheets made of an elastic material, attached to any or all rectangular planes of said right-triangular cylindrical members; wherein said elastic material is one selected from natural rubber, synthetic rubber, and silicone rubber.

3. A convertible triangular pillow as recited in claim 1, wherein purpose of use, precautions in use, and representative examples are displayed on any or all rectangular planes of said right-triangular cylindrical members.

4. A method of preparing the convertible triangular pillow recited in claim 1 for use as a chiropractic aid accompanying chiropractic therapy on a patient, the method consisting essentially of one of the following, selected so as to accord with anteroposterior curvature as determined by the patient's figure and physique in the lumbosacral region of the patient's spine:

(1) employing said two right-triangular cylindrical members in combination by hinging together by means of said first surface fastener said two right-triangular cylindrical members along their right-angle corners, and fastening together by means of second surface fasteners the surfaces defined by the counterpart short sides of said right-triangular cylindrical members;

(2) employing said two right-triangular cylindrical members in combination by hinging together by means of said first surface fastener said two right-triangular cylindrical members along their right-angle corners, and stacking together the surfaces defined by the right-angle corners and the long sides of said right-triangular cylindrical members;

(3) employing said two right-triangular cylindrical members isolated and separately by removing said first surface fastener to unhinge said two right-triangular cylindrical members along their right-angle corners;

(4) employing said two right-triangular cylindrical members in combination by removing said first surface fastener to unhinge said two right-triangular cylindrical members along their right-angle corners, and putting said right-triangular cylindrical members in an arrangement in which neither the surfaces defined by the counterpart hypotenuses nor by the counterpart long sides of said right-triangular cylindrical members are stacked together; and (5) employing said two right-triangular cylindrical members in a form in which their cross-sectional contour is a rectangle or parallelogram in form, removing said first surface fastener to unhinge said two right-triangular cylindrical members along their right-angle corners, and putting said right-triangular cylindrical members in an arrangement in which either the surfaces defined by the counterpart hypotenuses or by the counterpart long sides of said right-triangular cylindrical members are stacked together.

5. A method of preparing the convertible triangular pillow recited in claim 2 for use as a chiropractic aid accompanying chiropractic therapy on a patient, the method consisting essentially of one of the following, selected so as to accord with anteroposterior curvature as determined by the patient's figure and physique in the lumbosacral region of the patient's spine:

(1) employing said two right-triangular cylindrical members in combination by hinging together by means of said first surface fastener said two right-triangular cylindrical members along their right-angle corners, and fastening together by means of second surface fasteners the surfaces defined by the counterpart short sides of said right-triangular cylindrical members;

(2) employing said two right-triangular cylindrical members in combination by hinging together by means of said first surface fastener said two right-triangular cylindrical members along their right-angle corners, and stacking together the surfaces defined by the right-angle corners and the long sides of said right-triangular cylindrical members;

(3) employing said two right-triangular cylindrical members isolated and separately by removing said first surface fastener to unhinge said two right-triangular cylindrical members along their right-angle corners;

(4) employing said two right-triangular cylindrical members in combination by removing said first surface fastener to unhinge said two right-triangular cylindrical members along their right-angle corners, and putting said right-triangular cylindrical members in an arrangement in which neither the surfaces defined by the counterpart hypotenuses nor by the counterpart long sides of said right-triangular cylindrical members are stacked together; and (5) employing said two right-triangular cylindrical members in a form in which their cross-sectional contour is a rectangle or parallelogram in form, removing said first surface fastener to unhinge said two right-triangular cylindrical members along their right-angle corners, and putting said right-triangular cylindrical members in an arrangement in which either the surfaces defined by the counterpart hypotenuses or by the counterpart long sides of said right-triangular cylindrical members are stacked together.

6. A method of preparing the convertible triangular pillow recited in claim 3 for use as a chiropractic aid accompanying chiropractic therapy on a patient, the method consisting essentially of one of the following, selected so as to accord with anteroposterior curvature as determined by the patient's figure and physique in the lumbosacral region of the patient's spine:

(1) employing said two right-triangular cylindrical members in combination by hinging together by means of said first surface fastener said two right-triangular cylindrical members along their right-angle corners, and fastening together by means of second surface fasteners the surfaces defined by the counterpart short sides of said right-triangular cylindrical members;

(2) employing said two right-triangular cylindrical members in combination by hinging together by means of said first surface fastener said two right-triangular cylindrical members along their right-angle corners, and stacking together the surfaces defined by the right-angle corners and the long sides of said right-triangular cylindrical members;

(3) employing said two right-triangular cylindrical members isolated and separately by removing said first surface fastener to unhinge said two right-triangular cylindrical members along their right-angle corners;

(4) employing said two right-triangular cylindrical members in combination by removing said first surface fastener to unhinge said two right-triangular cylindrical members along their right-angle corners, and putting said right-triangular cylindrical members in an arrangement in which neither the surfaces defined by the counterpart hypotenuses nor by the counterpart long sides of said right-triangular cylindrical members are stacked together; and (5) employing said two right-triangular cylindrical members in a form in which their cross-sectional contour is a rectangle or parallelogram in form, removing said first surface fastener to unhinge said two right-triangular cylindrical members along their right-angle corners, and putting said right-triangular cylindrical members in an arrangement in which either the surfaces defined by the counterpart hypotenuses or by the counterpart long sides of said right-triangular cylindrical members are stacked together.

7. A method of using, as a chiropractic aid accompanying chiropractic therapy, the convertible triangular pillow as prepared according to any one of claims 4–6, in combination with pads of three types whose cross-sectional contour is wedge-shaped and whose transverse width is on the order of that of a patient's body, said three types being a short-span wedge-shaped pad of length for covering the buttocks of the patient when the ridge of the wedge is set against the patient's lumbosacral region;

a mid-span wedge-shaped pad whose top surface is provided with shallow oblong recesses for receiving the patient's thighs, and that is of length for reaching the patient's knees; and a long-span wedge-shaped pad whose top surface is provided with a shallow oblong recess for receiving the patient's occiput, and that is of length for covering the patient's parietal region; the method:

employing one to three of said types of pad in combination with said convertible triangular pillow so as further to accord with anteroposterior curvature as determined by the patient's figure and physique in the lumbosacral region of the patient's spine.

8. A method according to claim 7, wherein two or more of said types of wedge-shaped pad are employed stacked one atop the other.

9. A method according to claim 7, wherein a quadrilateral-cylinder shaped rectangular pillow is additionally employed in combination with said convertible triangular pillow.

* * * * *